United States Patent [19]

Huang

[11] Patent Number: 4,894,918

[45] Date of Patent: Jan. 23, 1990

[54] BASIC PATTERN SKETCH DRAWING TECHNIQUE FOR SLEEVE TAILORING

[76] Inventor: Ding S. Huang, 5th Floor, No. 9-16, Lane 344, Nanking W. Rd., Taipei, Taiwan

[21] Appl. No.: 194,318

[22] Filed: May 16, 1988

[51] Int. Cl.[4] ..... A41H 3/00

[52] U.S. Cl. ..... 33/17 R; 33/12

[58] Field of Search ..... 33/17 R, 17 A, 11, 12

[56] References Cited

U.S. PATENT DOCUMENTS

| | | | |
|---|---|---|---|
| 234,821 | 11/1880 | Taylor | 33/12 |
| 355,583 | 1/1887 | Brooke | 33/17 R |
| 361,292 | 4/1887 | Jackson | 33/12 |
| 1,482,797 | 2/1924 | Kelly | 33/12 |
| 1,529,411 | 3/1925 | Koewing | 33/12 |
| 2,589,105 | 3/1952 | Maiocchi | 33/17 A |
| 3,369,300 | 2/1968 | Green | 33/17 R |
| 4,144,647 | 3/1979 | Mosey et al. | 33/17 R |
| 4,222,170 | 9/1980 | Koontz | 33/17 A |

FOREIGN PATENT DOCUMENTS

| | | | |
|---|---|---|---|
| 2324716 | 11/1974 | Fed. Rep. of Germany | 33/12 |
| 314321 | 7/1934 | Italy | 33/12 |
| 601293 | 7/1960 | Italy | 33/12 |
| 0971237 | 11/1982 | U.S.S.R. | 33/17 R |
| 1031430 | 7/1983 | U.S.S.R. | 33/17 R |
| 1120962 | 10/1984 | U.S.S.R. | 33/12 |

*Primary Examiner*—William A. Cuchlinski, Jr.
*Assistant Examiner*—Thomas B. Will
*Attorney, Agent, or Firm*—Bucknam and Archer

[57] ABSTRACT

In a process of preparing a sketch to be used as a pattern for custom-tailoring at least a portion of a garment from selected material to fit a human figure of predetermined dimensions, the sketch is derived from a basic configuration for the desired portion of the garment, but in which selected dimensions are chosen in accordance with a set of predetermined measurements of the torso of the wearer.

6 Claims, 7 Drawing Sheets

BASIC PATTERN SKETCH DRAWING TECHNIQUE FOR SLEEVE TAILORING

BACKGROUD OF THE INVENTION

The present invention relates to a basic formula for an active sketch drawing in sleeve tailoring and more particularly a basic formula to measure the figure of a human body so as to alternatively fit the differences in body figure.

Regular sketch drawing in tailoring is unvarying and can not discover the defect in body figure for compensation in advance, thereby misfit happens quite often and further alteration is usually required, therefore, regular layout drawing technique is not perfectly applicable in mass production.

The main object of the present invention is to provide a right technique in body figures' measurement, and a basic formula for an active sketch drawing in sleeve tailoring so as to promote the quality, reduce the loss, and increase the productivity and the profit.

Another object of the present invention is to provide an active sketch drawing technique such that the dressmaker can easily handle with the variation in body figure while tailoring so as to prevent any further alteration.

DETAILED DESCRIPTION OF THE PREFERRED EMBODIMENTS

Figure 1:
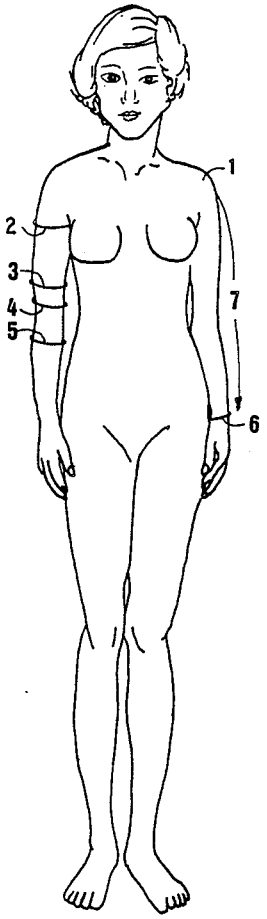
FIG. 1–2 show the measuring technique applied on all position required according to the present invention.
Figure 2:
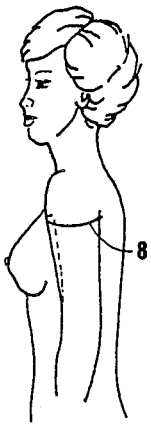

Please refer to FIG. 1 and FIG. 2. The basic sketch pattern drawing for one piece sleeve is completed by obtaining the measures from the following:

Shoulder point positioning (1): At both terminal ends of the shoulder.

Measure (2): Measure one circle around the arm beneath the armpit measure (2A) being the shortest vertical distance from shoulder point 1 to armpit part 2 on FIG. 1.

Measure (3): Measure one circle around the arm 2.5 cm above the elbow measure (3A) being the shortest vertical distance from shoulder point 1 to above elbow part 3 on FIG. 1.

Measure (4): Measure one circle around the largest part of the arm beneath the elbow measure (4A) being the shortest vertical distance from shoulder point 1 to largest arm part 4 on FIG. 1.

Measure (5): Measure one circle around the largest part of the arm beneath the elbow and below the measure (4) measure (5A) being the shortest vertical distance from shoulder point 1 to largest arm part 5 on FIG. 1.

Measure (6): Measure one circle around the wrist.

Measure (7): Measure the length from the shoulder point to the cuff you require.

Measure (8): Measure the length from the front armpit to the back armpit externally around the arm as shown by line 8 on FIG. 1.

Figure 3:
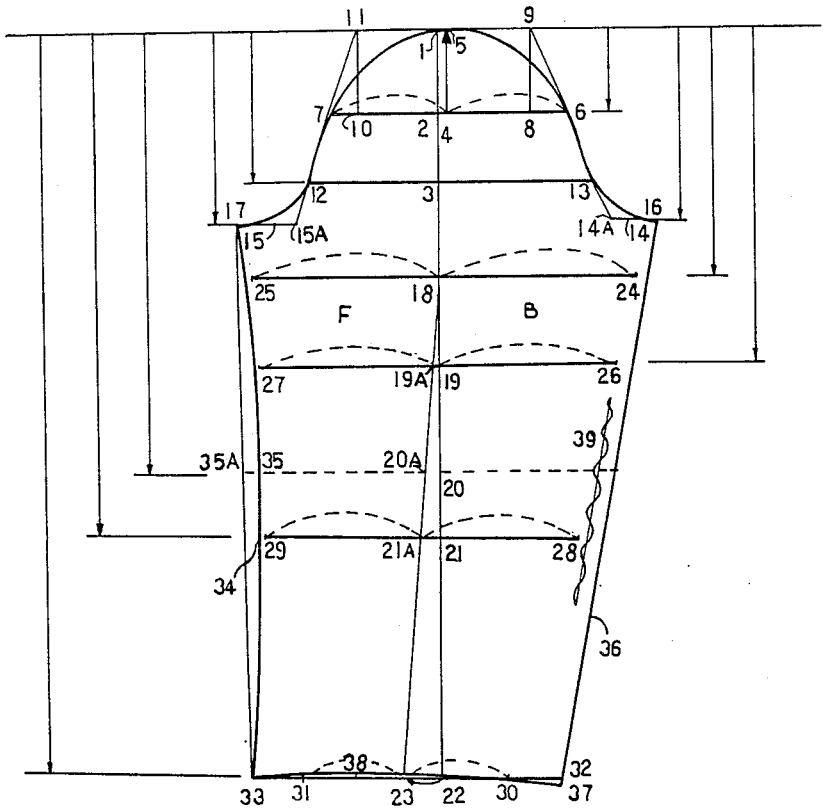
FIG. 3–4 show the drawing process of the sketch drawing technique for basic sleeve patterns according to the present invention.

The basic sleeve sketch pattern drawing process is as shown in FIG. 3, to firstly draw a horizontal line and set a central point (1) and draw a vertical line from the point (1) as an initial line to form a T shaped line, then to set a point (2) along the vertical line at 6.3 cm below the point (1) and draw a horizontal line through the point (2), and then set a point (3) along the vertical line at 11.5 cm below the point (1) and draw a horizontal line through the point (3); to set a point (4) along the horizontal line at 2.5 cm rightward from the point (2) and draw a vertical line upward to cross with the horizontal line passing through point (1) at a cross point (5); to set a point (7) and a point (6) leftward and rightward respectively along the horizontal line at a distance equal to $\frac{1}{4}$ of the measure (2) +0.5 cm from the point (4); to set a point (8) along the horizontal line at 2.5 cm leftward from the point (6) and draw a vertical line upward from the point (8) to cross with the horizontal line passing through point (1) at a cross point (9); to set a point (10) along horizontal line at 2 cm rightward from the point (7) and draw a vertical line upward from the point (7) to cross with the horizontal line passing through point (1) at a cross point (11); to draw respective oblique lines to connect points (6) and (9) and points (7) and (11) letting the oblique lines extending downward; draw a horizontal line (14) and another horizontal line (15) in parallel with the horizontal line passing through point (1) at a distance equal to 7 cm+$\frac{1}{4}$ of the measure (2) from the latter line letting the line (14) cross with the oblique line that pass through points (9) and (6) at a cross point (14A), and letting the line (15) cross with the oblique line that passing through points (11) and (7) at a cross point (15A); to draw a curved line from the point (1) through an internal angle at a vertical distance 1.7 cm below the point (9) and through the point (6) and the point (13) and then passing through an external angle at a vertical upward distance 1.2 cm from the point (14A) to cross with the horizontal line (14) at a cross point (16); to draw a curved line from the point (1) through an internal angle at a vertical downward distance of 2 cm from the point (11) and through the point (7) and the point (12) and then passing through an external angle at a vertical upward distance of 1 cm from the point (15A) to cross with the horizontal line (15) at a cross point (17); to set a point (18) downward along the vertical line from the point (1) according to the measure (2A) and draw a vertical line as a second arm line; to set a point (19) downward along the vertical line from the point (1) according to the measure (3A) and draw a vertical line as a second arm line; to set a point (20) downward along the vertical line from the point (1) according to the measure (4A) and draw a horizontal line as an elbow line; to set a point (21) downward along the vertical line from the point (1) according to the measure (5A) and draw a horizontal line as a wrist line; to set a point (22) downward along the vertical line from the point (1) according to the measure (7) and draw a horizontal line as a cuff line; to set a point (23) at 2.5 cm leftward along the horizontal line from the point (22) and draw an oblique line to connect points (18) and (23) and to cross with the horizontal line (19) at (19A) with the horizontal line (20) at (20A), with the horizontal line (21) at (21A); to set points (25) and (24) leftward and rightward respectively along the horizontal line (18) from the point (18) at a distance equal to ½ of the measure (2); to set points (27) and (26) leftward and rightward respectively along the horizontal line from the point (19A) at a distance equal to ½ of the measure (3); to set points (29) and (28) leftward and rightward respectively along the horizontal line (21) from the point (21A) at a distance equal to ½ of the measure (5); to set points (31) and (30) leftward and rightward respectively along the cuff line from the point (23) at a distance equal to ½ of the measure (6) and then to set points (33) and (32) respectively at 4 cm outward from points (31) and (30); to draw a vertical line (34) to connect points (17) and (33) and to cross with the elbow line (20) at a cross point (35A) and then set a point (35) at 1 cm rightward from the point (35A) and then to draw an internal side line to connect points (17), (25), (35) and (33); to draw a vertical line (36) to connect points (16) and (32) and extending 0.5 cm downward through the point (32) to obtain a point (37), and to draw a curved line from the point (33) to the point (37) letting the peak point of the curved line be at 0.5 cm above the cuff line (the straight line 33–37) so as to complete the basic layout model for one piece sleeve. In the drawing of FIG. 3, the arrow represents drawing direction, F represents forward pressing, B represents backward pressing, and the curved line (39) represents shrinkage by pressing.

The basic sketch pattern of one piece sleeve drawing technique is featuring in that:

(1) In the basic sketch pattern of FIG. 3, the depth of sleeve cap is about 2 cm shorter than the depth of the arm hole, in case of loosen style, the depth of the sleeve cap can be properly increased; in case of tight style, the depth of the sleeve cap should not be increased.

(2) In the basic sketch pattern, the width of half cap line and armpit line is just within the moving range of the arm. Any style tailoring shall be in accordance with this basic arrangement.

(3) In the basic sketch pattern, the sleeve is 2.5 cm wider than the measure (2), 3 cm wider than the measure (3), 2.5 cm wider than the measure (5), 7.5 cm wider than the measure (6) so that the arm can freely slip thereinto. Any style or any cloth used should be tailoring in accordance with the described arrangement.

Figure 4:
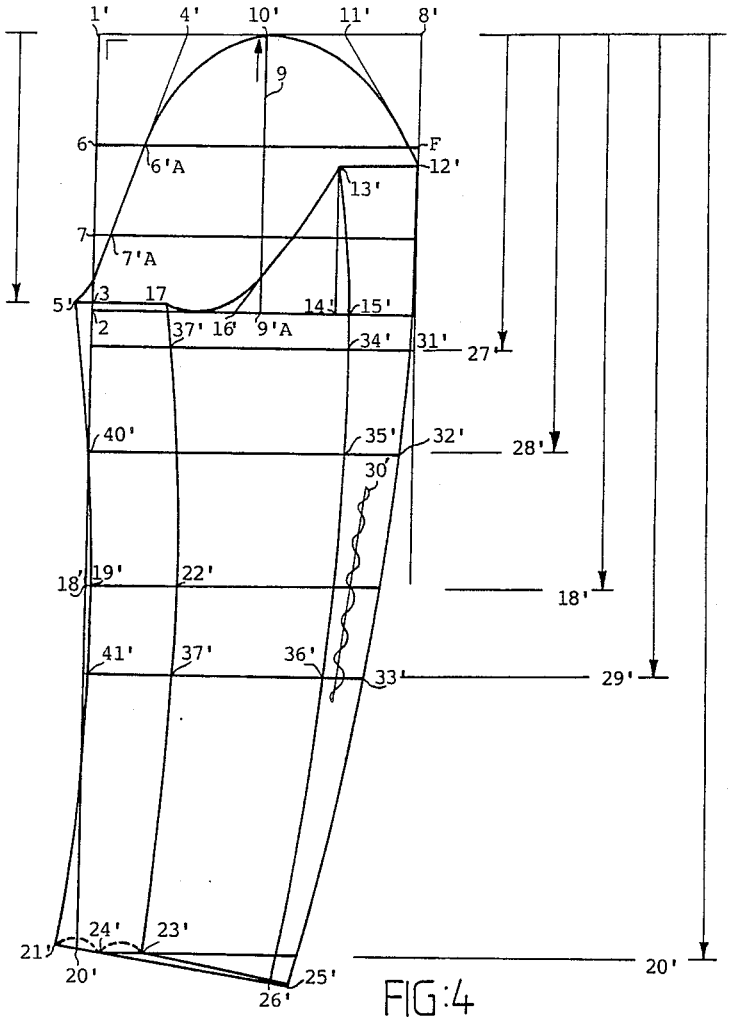

For the sleeve composed of two pieces of cloth, the sketch drawing procedure is completed as shown in FIG. 4, to firstly draw a horizontal line from point (1') and set a point (2') downward along a vertical line from the left end of the line (1) at a distance equal to 9 cm+¼ of the measure (2) and then draw a horizontal line as for the width of the top armhole, and then to set a point (3) at 1.3 cm upward along the vertical line from the point (2'); to set a point (4) rightward along the horizontal line from the point (1) at a distance equal to ¼ of the measure (2)−1.3 cm; to draw a central line between points (2') and (3') and set a point (5') leftward along the central line at 1 cm from the vertical line between points (2') and (3'); to set a point (6') at 6.3 cm downward along the vertical line from the point (1') and draw a horizontal line rightward from the point (6'); to set a point (7) at 11.4 cm downward along the vertical line from the point (1) and draw a horizontal line rightward from the point (7') as an armpit line; to set a point (8') rightward along the horizontal line from the point (1') at a distance equal to ½ of the measure of the total width of the shoulder seam −1.3 cm which is equivalent, as can be seen from FIG. 4, to four times the distance between points (1') and (4'), and draw a downward vertical line from the point (8'); to set the central point between points (1') and (8') as point (10') and draw a downward vertical line from the point (9'), then to make a mark of an arrow at 0.5 cm leftward from the vertical line (9') to serve as a matching point with the shoulder; to set the central point between points (9') and (8') as point (11'); set a point (F) at the cross point of the vertical line passing through point (8') and the horizontal line passing through point (6') and set a point (12') downward along the vertical line at 0.5 cm from the point (F) (to be defined later); and then set a point (13') at 2.5 cm leftward along the horizontal line from the point (12'), and then to draw a vertical line downward from the point (13') to cross with the horizontal line passing through point (2') at a cross point (14') and then to set a point (15') rightward along the horizontal line passing through point (2') at 0.5 cm from the point (14'); to draw a vertical line downward from the point (10') to cross with the horizontal line passing through point (2') at point (9'A) and then to set a point to (16') at 1.3 cm leftward along the horizontal line from the point (9'A); to set a point (17') at 5.3 cm rightward along the horizontal line from the point (5'); to set a point (6A') leftward along the half cap line extending rightwardly from (6') and spaced from the point F at a distance no less than 10 cm+¼ of the measure (2) as a width for half sleeve cap; to set a point (7'A) leftward from the vertical line passing through point (8) along the armpit line passing through point (7') and which will be seen on FIG. 4 to occur at the intersection of the latter line with the extension of the line passing through points (4') and (6'A), but can alternately be specified to occur at a distance not less than the measure (8)+3 cm along the horizontal line passing through the point (7') between the intersection points of the line joining the points (13') and (15'), on one hand, and the line joining the points (13') and (16') on the other hand; as a width of the armpit for the larger sleeve cap; to draw a sleeve cap line for the larger part thereof; from point (5') through point (7'A), (6'A) and through an internal angle spaced downwardly 2 cm from point (4') to point (10') and then passing through an internal angle spaced downwardly 1 cm from point (11') up to point (F); to draw a sleeve cap line for the smaller part thereof, from point (13') through an external angle 1 cm from point (16') and turning leftward horizontally up to the point (17'); to set a point (18') downward along the vertical line from point (1') at a distance equal to the arm length from the shoulder point to the elbow (measure 4A) and then draw a horizontal line therefrom as for the elbow line, and then to set a point (19') at 0.5 cm rightward from the point (18'); to set a point (20') downward along the vertical line from the point (1') at a distance equal to the measure (7) and draw a horizontal line, therfrom, then to set a point (21') at 1.5 cm leftward from the point (20'); to set a point (22') at 5.3 cm rightward from the point (19') along the elbow line passing through point (18'); to set a point (23') at 5.3 cm rightward from the point (21') along the cuff line passing through point (20'); note that point (17') occurs at the intersection of the horizontal line emanating rightwardly from point (5') and the upward extension of the line through points (23') and (22'), to set a point (24') at the center between points (21') and (23'), and set a point (25') at 2.5 cm below the horizontal line emanating from point (20'), and at a distance from the point (21') equal to [½ of the measure (6)+7.5 cm]+0.3 cm, and then to set a point (26') at 0.6 cm leftward from the point (25'); to draw a horizontal line (27') downward from the horizontal line (1') at a distance equal to the length from the shoulder point to the arm line (2') as for the measure (2A); to draw a horizontal line (28') downward from the horizontal line (1') at a distance equal to the length from the shoulder point to the lower arm line as for the measure (3A); to draw a horizontal line (29') downward from the horizontal line (1') at a distance equal to the length from the shoulder point to the elbow as for the measure (5A).

As can be seen from FIG. 4, connect the points (5'), (19') and (21') by a curved line; the latter curved line defines intersection points (40') and (41') with lines (28') and (29') connect the points (17'), (22') and (23') by curved line; the latter curved line defines intersection points (37'), (38') and (39') withlines (27'), (28') and (29'), connect the points (26'), (15') and (13') by a curved line, the latter curved line defines intersection points (34'), (35') and (36') with lines (27'), (28') and (29'), connecting the points (25') and (12') by another curved line, the latter curved line defines intersection points (31') (32') and (33') with the lines (27'), (28') and (29'), and join the points (21') (20'), (26') and (25') substantially along a straight line; define a large arm width occurring at the measure (2A) as the distance between the points (2') and (31'), and define a small arm width at the preceeding measure as the distance between the points (37') and (34'); set the large arm width plus the small arm width at the aforesaid preceeding measure to be not less than measure (2)+4 cm, define a lower large part arm width occurring at the measure (3A) as the distance between the points (40') and (32'), and define a lower small part arm width at the preceeding measure as the distance between the points (38') and (35'), and set the lower large part arm width plus the lower small part arm width at the aforesaid preceeding measure to be not less than measure (3)+4 cm; define a lower large elbow width occurring at the measure (5A) as the distance between the points (41') and (33'), and define a lower small part elbow width at the preceeding measure as the distance between the points (39') and (36'), and set the lower large part elbow width plus the lower small part elbow width at the aforesaid preceeding measure to be not less than measure (5)+4 cm, and mark a shrinkage curved line (30') within a substantially rectangular area defined by the points (35'), (32'), (33') and (36').

For one piece body sleeve, the basic sleeve sketch pattern is completed as described in the following preferred embodiment:

Shoulder point positioning (1): At both terminal ends of the shoulder.

Measure (2): Measure one circle around the arm beneath the armpit measure (2A) being the shortest vertical distance from shoulder point 1 to armpit part 2;

Measure (3): Measure one circle around the arm 2.5 cm above the elbow measure (3A) being the shortest vertical distance from shoulder point 1 to above elbow part 3;

Measure (4): Measure one circle around the largest part of the arm beneath the elbow measure (4A) being the shortest vertical distance from shoulder point 1 to largest arm part 4;

Measure (5): Measure one circle around the largest part of the arm beneath the elbow and below the measure (4) measure (5A) being the shortest vertical distance from shoulder point 1 to largest arm part 5;

Measure (6): Measure one circle around the wrist.

Measure (7): Measure the length from the shoulder point to the cuff you require.

Measure (8): Measure the length from the front armpit to the back armpit externally around the arm as shown by line 8 on FIG. 1.

Figure 5:
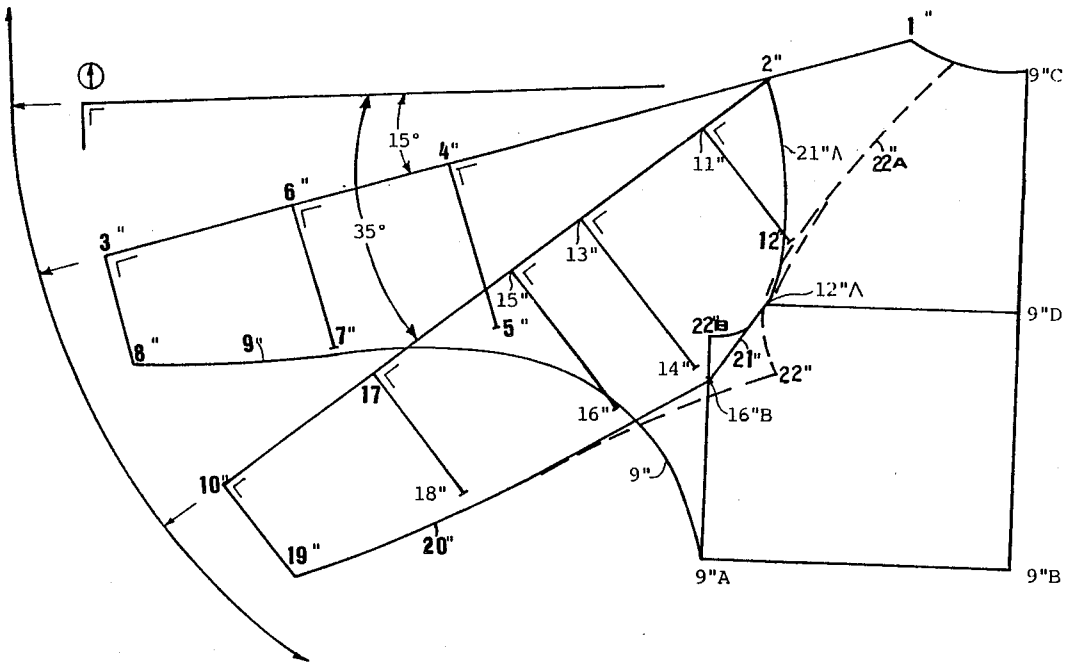
FIG. 5–6 show the drawing process of the sketch drawing technique for one piece sleeve, according to the present invention.
Figure 6:
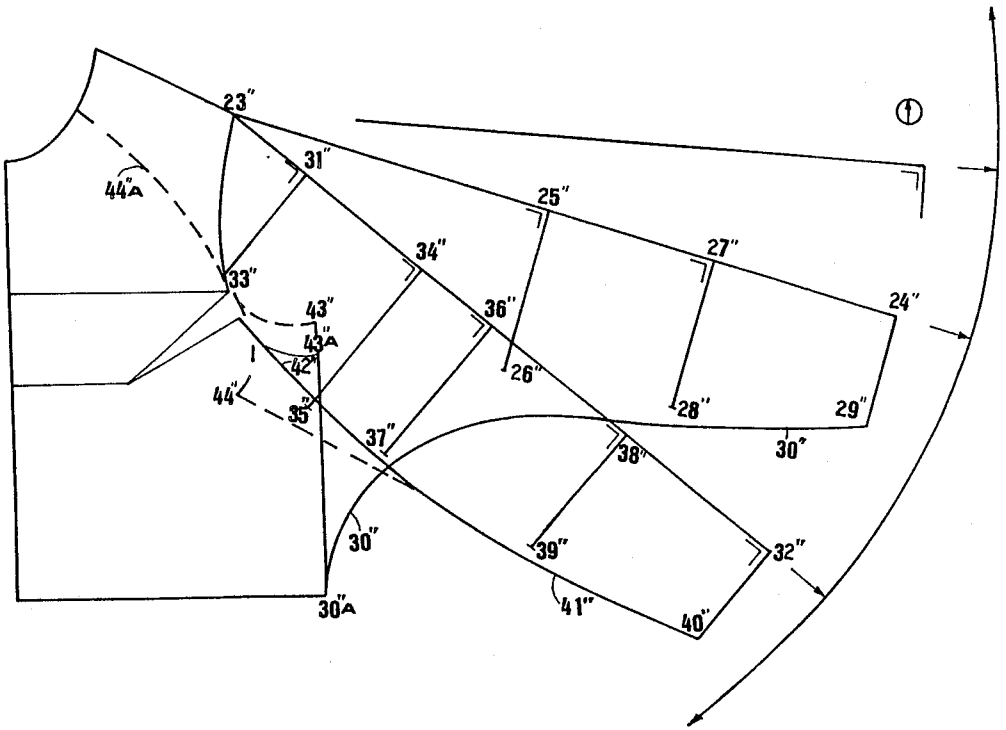

Start the sketch drawing according to the data obtained from the measures above mentioned and according to the formula of the present invention with reference to FIGS. 5, 6, 8, and 9 and according to the neck point (1'') and the shoulder point (2'') of the back part, to draw a straight line from point (1'') through point (2'') to form a sleeve central line and set a point (3'') at a distance from the point (2'') equal to the measure (7) as can be seen from FIG. 5, the line connecting points 1'' and 3'' subtends an angle of 15° with the horizontal, while the spacing between points (1'') and (2'') is about 1/5 the measure (7) to set a point (4'') downward along the straight line at a distance equal to the length from the shoulder to the arm line of measure (3A) and draw an upright line from the point (4'') at right angles from the line connecting points 1'' and 3'' to a length equal to ½ of the measure (3) so as to obtain a point (5); to set a point (6'') from the point (2'') downwardly along a straight line at a distance equal to the length from the shoulder point to the elbow line of the measure (5A) and draw upright line from the point (6'') to a length equal to ½ of the measure (5) so as to obtain a point (7''); to set a point (8'') downward along the vertical line from the point (3'') at a distance equal to ½ of the measure (6) as for cuff line; curved line (9) according to the style required to connect points as can be seen from FIG. 5, draw a line from the point (1'') leftwardly about ¼ of the distance separating points (2'') and (3'') for arriving at a point (9''A); draw from a leftmost terminal of the preceeding line a vertical downwardly at a spacing about ¾ of the distance separating points (2'') and (5''); connect the points (8''), (9''), (7''), (5'') and (9''A) by smoothly curved line (9''); draw a line rightwardly from the point (9''A) to a distance corresponding to about ½ the spacing between the points (2'') and (3'') so as to result in a point (9''B); to draw a vertical line from the point (9''B) so as to result in a point (9''C) at a spacing corresponding to about ¾ the distance between the points (2'') and (3''), and connect the points (9''C) and (1'') by a slightly concave curve corresponding to a wearer's neckline; the connecting lines between the points (9''A), (9''B), (9''C), (1'') and (2'') define the contour of a first half of a bodice. As can be seen from FIG. 5, the distance between points (1'') and (2'') is about one fifth the distance between points (2'') and (3''). In an alternate embodiment of the sleeve, particularly for the back part, draw a line to connect points (2'') (11'') as a sleeve central line, and then to set a point (13'') downward along the sleeve central line from the point (2'') at a distance equal to the measure (7), then to draw a line at right angles to the line connecting points (1'') and (3'') from the point (10'') as for cuff line, then to draw a line to connect points (11'') (12'') (13''), as for half sleeve cap line; the distance between points (11'') and (12'') being ½ the measure (3); to set a point (13'') downward along the line between point (2'') point (10''), at 18 cm from the point (2'') or at a distance equal to the length from the shoulder point 1 to the arm line (2), as seen in FIG. 1, and draw a vertical line from the point (13) at right angles to line (2'')–(10''), and then set a point (14'') downward from the (13'') at a distance equal to ½ of the measure (2); to set a point (15'') downward along the line through from point (2'') through point (10'') at a distance equal to the length from shoulder point to lower arm line (3) measure (3A), the distance between points (2″) and (11″) being ¼ of the distance between points (2″) and (15″), i.e. of the measure (3A), as can be seen from FIG. 5; and draw a line at right angles to the line (2″)–(10″) and then to set a point (16″) downward along the line from the point (15″) at right angles to the line (2″)–(10″); at a distance equal to ½ of the measure (3); to set a point (17″) downward from point (2) along the line through points (2″) (10″) at a distance equal to the length from shoulder point 1 to the lower arm line beneath the elbow (5″) as seen in FIG. 1 (measure 5A), and draw a line at right angles to line (2″)–(10″) and set a point (18″) downward along the line from the point (17″) at a distance equal to the measure (5); to set a point (19″) downward along the cuff line from the point (10″) at a distance equal to ½ of the measure (6); for arriving at a point (9″A) draw a line from the point (1″) leftwardly about ¼ of the distance separating points (2″) and (10″), and from a leftmost terminal of the preceeding line draw a vertical downwardly at a spacing about ¾ of the distance separating points (2″) and (10″), connect the points (19″), (18″), and (16″) by smoothly curved line (20″), a point (16″B) lying on a continuation of the line connecting the points (18″) and (16″) intersecting with the vertical emanating upwardly from the point (9A″), draw a line rightwardly from the point (9″A) to a distance corresponding to about ½ the spacing between the points (2″) and (3″) resulting in a point (9″B), draw vertical line from the point (9″B) resulting in a point (9″C) at a spacing corresponding to about ¾ the distance between the points (2″) and (3″), connect the points (9″C) and (1″) by a slightly concave curve corresponding to a wearer's neckline, the connecting lines between the points (9″A), (9″B), (9″C), (1″) and (2″) defining the contour of a first half of a bodice, draw a line (21″) inclined at an angle of about 53° with the horizontal rightwardly from the point (16″B), draw a horizontal line leftwardly from a point (9″D) situated vertically about ⅓ the distance between the points (2″) and (10″), and marking a point (12″A) at an intersection of the preceeding horizontal line with the line (21″), draw a curved line (21″A) smoothly connecting the points (12″A), (12″) and (2″), and draw a smoothly curved line (22″A) connecting points (12″A), (12″) and an approximate midway point of the line connecting the points (1″) and (9″), said line (22″A) defining a cutting line adapted for the insertion of a gore, the line (9″B), (9″D) and (9″C) defining a bodice center line, as can be seen from FIG. 5. In a still alternate embodiment, particularly for the front part, please refer to FIG. 6 and FIG. 9, to set a point (24″) from the shoulder point (23″) of the front part at a distance equal to that between points (9″A) and (3″) of the back part so as to obtain a central point of the cuff line; to set a point (25″) from the point (23″) at a distance equal to the size between points (2″) and (4″) and draw a line at right angles to line (23″) to (24″) from the point (25″) against the central line and then set a point (26″) along the preceedingly defined right angles line from the point (25″) at a distance equal to that between points (4″) and (5″); to set a point (27″) from the point (23″) at a distance equal to that between points (2″) and (6″) and draw a line at right angles to line (23″) to (24″) and then to set a point (28″) from the point (27″) at a distance equal to that between points (6″) and (7″); to draw a line at right angles to the central line (23″) and (24″) from the point (24) as a cuff line and set a point (29″) from the point (24″) at a distance equal to that between points (3″) and (8″); to draw a curved line (30″) mirror-symmetrical with the curved line (9″) to connect the point (30″A) and the outer side of points (26″) (28″) (29″) to complete the full basic sleeve pattern for the one piece body sleeve. In an alternate embodiment, set a point (31″) and a point (33″) from point (23″) in the same way as the lines between points (2″) (11″) and points (11″) (12″), have been set; in FIG. 6, line (23″) to (24″) is shown to subtend an angle of 13° with the horizontal, while the line (23″) to (32″) is shown to subtend an angle of 35° with the horizontal; and extend the central line from point (23″) through point (31″) to the point (32″) according to the distance between points (2″) and (10″); to set a point (34″) along the central line from point (23″) at a distance equal to that between points (2″) and (13″) and draw a line at right angles to the central line and then set a point (35″) downward along the preceeding right angles line from the point (34″) at a distance equal to that between points (13″) and (14″); to set a point (36″) along the central line from the point (23″) at a distance equal to that between points (2″) and (15″) and draw a line, preceeding right angles and then set a point (37″) downward along the preceeding right angles line from the point (36″) at a distance equal to that between points (15″) and (16″); to set a point (38″) downward along the central line from the point (23″) at a distance equal to that between points (2″) and (17″) and draw a line at right angles to the central line, and then to set a point (39″) downward along the line from the point (38″) at a distance equal to that between points (17″) and (18″); to set a point (40″) from the point (32″) along the cuff line at a distance equal to that between points (10″) and (19″); to draw an internal side line (41″) according to the style in a mirror-symmetrical manner with respect to internal side line (20″) to pass by points (35″) (37″) (39″) (40″), and draw an upright line at a cross point between the curved line (41″) and the vertical side line of the front part (30″A) (43″A) to cut with the arm hole curved line of the front part for the insertion of a gore; if the front part has a cut joining line to the arm hole, the bust dart should be set an another place or remain at the original place for stitching, then draw an opposite curved line (44″A) from a point (43″A) at a proper distance above the point (43″A) to pass through point (33″) to the arm hole curved line; set a point (44″) from the point (40″) at a distance equal to that between points (19″) and (22″), and draw a curved line to connect the point (44″) and to cut with the front curved line (44″A) to form an adjustable cut joing line.

While in application, the pattern drawing formula above described is performed as follows:

1. For one-piece sleeve:

(A) Sleeve length: Extend or abstract the central line to a proper length required.

(B) The width of the sleeve: In a style that requires a larger size than indicated in the basic pattern, the central line can be raised up and shall not be moved down.

(C) Style variation: According to the length and the width of the sleeve determined and set, dart, cutting, cuttling, joining can be started as required.

Figure 7:
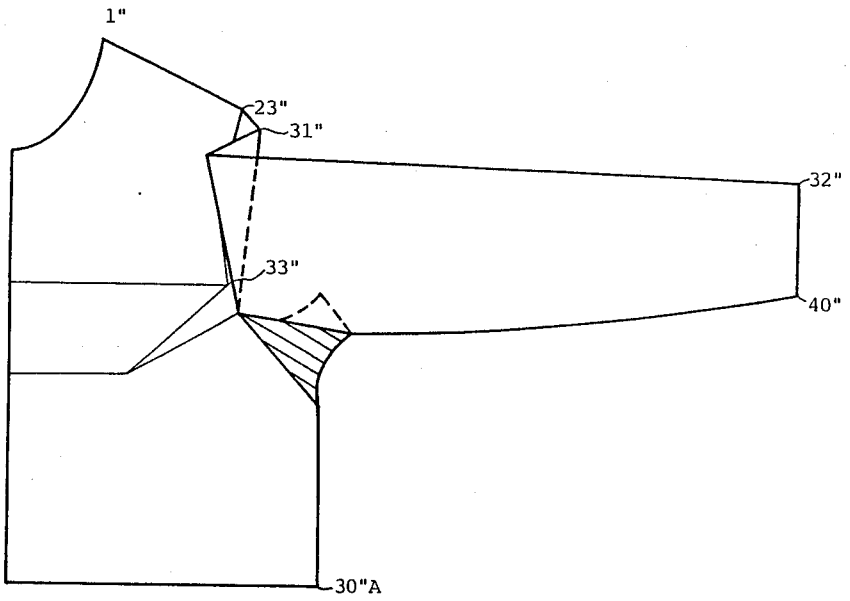
FIG. 7 shows the measuring technique in obtaining the measure of the gore for one piece sleeve, according to the present invention.
Figure 8:
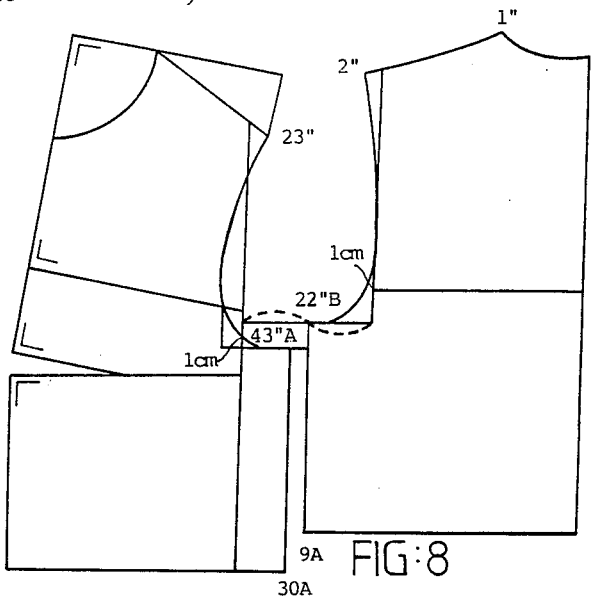
FIG. 8–9 show the basic sketch pattern drawing technique for the tops.
Figure 9:
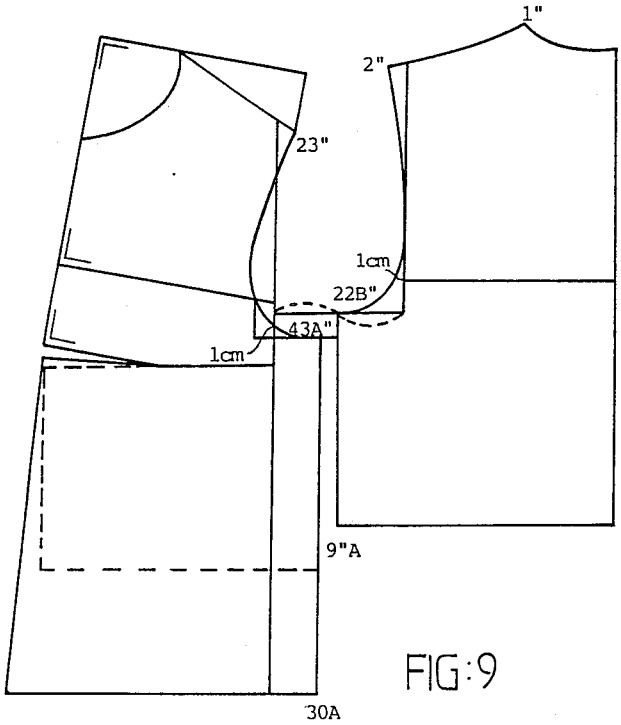

2. For insertion of a gore (see FIGS. 6 and 7):

(A) Sleeve length: Extend or abstract the central line to a proper length required.

(B) The width of the sleeve: (1) During the sketch pattern drawing process, the distance between points (31″) and (32″) is to control the central line and can not be reduced.

(2) The insertion of the gore is arranged not to exceed the level of the armpit. The inclination of the gore is determined according to the style, the loose part at the arm line and the cross point between the front part and the back part of the body. The front length and the back length of the gore is not identical. The width of the gore is determined according to the style, but the internal side of the sleeve and the internal side of the body shall be equal.

(C) Style variation: According to the length and the width of the sleeve determined and set, dart, cutting, cuttling, and joining can be started as required.

3. For cut joining:

(A) The arrangement of the width and the length of the sleeve:

Arrange as described in the insertion of gore.

(B) Style variation: Bust dart be temporarily set at other place and then start to draw for armhole to match with the sleeve cap according to style required and in accordance with the side line of the other part and to meet with the cut joining line of the body.

According to the described basic formula, one can easily draw a sketch for sleeves to fit all figures and styles.

I claim:

1. In a process of preparing a sketch to be used as a pattern for tailoring at least a portion of a garment to fit a human figure of predetermined dimensions, wherein firstly the terminal ends of each shoulder are defined as shoulder points, secondly the circumference around each arm beneath each respective armpit is defined as measure (2), while the shortest distance from the shoulder point to the respective armpit is defined as measure (2A), thirdly the circumference around each arm 2.5 cm above a respective elbow is defined as measure (3), while the shortest distance from a shoulder point to the respective preceeding circumference is defined as measure (3A), fourthly the circumference around a largest part of each arm beneath a respective elbow is defined as measure (4), while the shortest distance from a shoulder point to the respective preceeding circumference is defined as measure (4A);

fifthly the circumference around another largest part of each arm beneath a respective elbow and below said measure (4) is defined as measure (5), while the shortest distance from a shoulder point to the respective preceeding circumference is defined as means (5A), sixthly the circumference around each respective wrist is defined as measure (6), seventhly the distance from each shoulder point to a respective cuff of the garment is defined as measure (7), and eightly the distance from each front armpit to each respective back armit is defined as measure (8), the steps comprising drawing a horizontal line, setting a central point (1) on said horizontal line, drawing a line in a downward direction from point (1), marking a point (2) along said downwardly directed line spaced 6.3 cm from said point (1), drawing a horizontal line through said point (2), marking a point (3) along said downwardly directed line 11.5 cm below said point (1), drawing a horizontal line through said point (3), marking a point (4) on said preceeding horizontal line at 2.5 cm rightward from said point (2), drawing a vertically upward directed line through said point (4) to intersect with the horizontal line passing through said point (1) so as mark an intersection point (5), marking points (6) and (7), respectively, rightwardly and leftwardly from said point (4) on the horizontal line passing through said point (4), at respective distances equalling $\frac{1}{4}$ of the measure (2)+5 cm, marking a point (8) along said horizontal line passing through said point (4) 2.5 cm leftwardly from said point (6), so as to yield an intersection point (9) with said horizontal line passing through said point (1), marking a point (10) on said horizontal line passing through said point (2) 2 cm rightwardly from said point (7), drawing an upwardly directed vertical line through said point (10) so as to yield an intersection point (11) with said line passing through said point (1), drawing downwardly slanting lines passing through points (6) and (9), and points (7) and (11), respectively, drawing horizontal lines (14) and (15) in parallel with said horizontal line passing through said point (1) at a distance of 7 cm+$\frac{1}{4}$ of the measure (2) therefrom, so as to yield respective intersections points (14A) and (15A) with the lines passing through points (6) and (9), and (7) and (11), respectively, drawing a first S-shaped curved line from said point (1) so as to pass beneath said point (9) at a vertical distance of 1.7 cm therefrom, and so as to be tangent to the line passing downwardly through said points (6) and (13) until the intersection with the last-named line with said horizontal line passing through said point (3), so as to yield an intersection point (13), and so as to pass above said point (14A) at a vertical distance of 1.2 cm therefrom, until it intersects with the horizontal line passing through said point (14) yieldin an intersection point (16), drawing a second S-shaped curved line from said point (1) so as to pass beneath said point (11) at a vertical distance of B2 cm therefrom, and so as to be tangent to the line passing downwardly through said points (11) and (7) until the intersection with the last-named line with said horizontal line passing through said point (3), so as to yield an intersection point (12), and so as to pass above said point (15A) at a vertical distance of B1 cm therefrom, until it intersects with the horizontal line passing through said point (14) yielding an intersection point (17), said S-shaped curves being tangent to the horizontal near said point (1), marking a point (18) downwardly along the vertical line passing through said point (1) according to measure (2A), marking points (19), (20), (21) and (22), along the line passing vertically downwardly from the point (1) according to measures (3A), (4A), (7A) and (7), respectively, drawing horizontal lines through points (19), (20) and (21), respectively, the last-named line defining a cuff line, marking a point (23) 2.5 cm leftwardly from the point (22) on said cuff line, connecting points (23) and (18) to yield intersection points (19A), (20A), and (21A) with the horizontal lines passing through the points (19), (20) and (21), respectively, marking points (24) and (25) at rightward and leftward spacings of ½ the measure (2) from the point (18), respectively, marking points (26) and (27) rightwardly and leftwardly from the point (19A), at a distance equal to ½ the measure (3), respectively, along the horizontal line passing through the point (19A), marking points (28) and (29) rightwardly and leftwardly from the point (21A), at a distance equal to ½ the measure (5), respectively, along the horizontal line passing through the point (21A), marking points (30) and (31) rightwardly and leftwardly from the point (23), at a distance equal to ½ the measure (6), respectively, along the horizontal line passing through the point (23), marking points (32) and (33) 4 cm rightwardly and leftwardly from the points (30) and (31), respectively, along the horizontal line passing through the point (23), drawing an upward vertical line (34) to connect the points (33) and (17) so as to intersect at intersection points (34) and (35A) with the horizontal lines passing through the points (21) and (20), respectively, and setting points (29) and (35) at 1 cm rightwardly from said points (34) and (35A), respectively, along corresponding of said horizontal lines, drawing a curved line so as smoothly connect the points (15), (25), (27), (35), (29), and (33), drawing a downwardly directed line (36) to connect points (16) and (32), and extending the line (36) 0.5 cm downwardly from the point (32) so as to obtain a point (37), and drawing a smoothly curved line connecting the points (33) and (37) so that a peak point of said smoothly curved line is situated 0.5 cm above the straight line connecting the points (32) and (33).

2. In a process of preparing a sketch to be used as a pattern for tailoring a garment, and in particular a sleeve made up of two pieces of cloth to fit the arm of a human figure of predetermined dimensions, wherein firstly the terminal ends of each shoulder are defined as shoulder points, secondly the circumference around each arm beneath each respective armpit is defined as measure (2), while the shortest distance from the shoulder point to the respective armpit is defined as measure (2A), thirdly the circumference around each arm 2.5 cm above a respective elbow is defined as measure (3), while the shortest distance from a shoulder point to the respective preceeding circumference is defined as measure (3A), fourthly the circumference around a largest part of each arm beneath a respective elbow is defined as measure (4), while the shortest distance from a shoulder point to the respective preceeding circumference is defined as measure (4A);

fifthly the circumference around another largest part of each arm beneath a respective elbow and below said measure (4A) is defined as measure (5), while the shortest distance from a shoulder point to the respective preceeding circumference is defined as means (5A), sixthly the circumference around each respective wrist is defined as measure (6), seventhly the distance from each shoulder point to a respective cuff of the garment is defined as measure (7), and eighthly the distance from each front armpit to each respective back armit is defined as measure (8), the steps comprising drawing a horizontal line from an upper corner point (1'), drawing a vertically dowwardly pointing line from the point (1'), marking on said downwardly pointing line a point (2') spaced 9 cm+¼ of the measure (2), drawing a rightwardly pointing horizontal line from the point (2'), marking a point (3') 1.3 cm upward on the vertical line joining points (1') and (2'), marking a points (4') rightwardly from the point (1') at distance of ¼ of the measure (2)−1.3 cm, drawing a horizontal central line passing midway between the points (2') and (3'), marking a point (5') leftwardly 1 cm from the intersection of said horizontal central line with the vertical line joining points (2') and (1'), marking a point (6') 6.3 cm downwardly from the point (1') along the line joining points (1') and (2'), drawing a horizontal line rightwardly from the point (6'), marking a point (7') 11.4 cm downwardly on the line joining points (1') and (2'), drawing a horizontal armpit line rightwardly from the point (7'), drawing a point (8') rightwardly on the horizontal line passing through point (1') at a distance from the point (1') which is four times the spacing between points (1') and (4');

drawing a vertically downwardly pointing line from the point (8'), marking a central point (10') midway between the points (1') and (8'), drawing a downwardly pointing vertical line (9') from the point (10'), drawing an upwardly pointing arrow spaced 0.5 cm leftwardly from the line (9'), and parallel therewith, to serve as matching point for the shoulder, marking a central point (11') midway between the points (10') and (8'), marking an intersection point (F) at the intersection between the vertically downwardly pointing line from the point (8') and the rightwardly pointing horizontal line from the point (6'), marking a point (12') 0.5 cm vertically downward from the point (F), drawing a line leftwardly from the point (12') and marking a point (13') 2.5 cm leftwardly from the point (12'), drawing a vertical line downwardly from the point (13') so as to intersect with the horizontal line emanating from the point (2') and yield an intersection point (14'), drawing a line rightwardly from the point (14') and marking a point (15') at 0.5 cm rightwardly from the point (14'), marking a point (9'A) on the line (9') to intersect with the horizontal line emanating from the point (2'), marking a point (16') 1.3 cm leftwardly from the point (9'A), drawing a rightward horizontal line from the point (5') and marking a point (17') 5.3 cm rightwardly from the point (5'), marking a point (6'A) along the line connecting points (6') and (F) at a leftward distance from the point (F) no less than 10 cm+$\frac{1}{4}$ of the measure (2)

marking a point (7'A) along the horizontal line passing through the point (7') leftward from the vertical line passing through the point (8') at a spacing no less than the measure (8)+3 cm+ intercepts along said horizontal line passing through said point (7') between the intersection points of the line joining the points (13') and (15'), on one hand, and the line joining the points (13') and (16'), on the other hand, drawing a half S-shaped sleeve point line from the point (5') upwardly through the points (7'A) and (6'A), passing a point 2 cm below the point (4'), through the point (10'), and therefrom downwardly through a point 1 cm below the point (11') to the point (F), drawing a smoothly curved sleeve cap line turning downwarly from the point (13') through a point spaced 1 cm from the point (16'), passing therethrough and thereafter following tangentially along the line emanating horizontally rightwardly from the point (2') up to the point (17'), marking a point (18') downwardly along the vertical line from the point (1') at a distance equal to the measure (4'A), drawing a horizontal elbow line rightwardly from the point (18') and marking a point (19') thereon which is located 0.5 cm rightwardly from the point (18'), marking a point (20') vertically downwardly from the point (1') at a distance equal to the measure (7), drawing a horizontal line through the point (20') and marking a point (21') thereon which is 1.5 cm leftwardly from the point (20'), marking a point (22') 5.3 cm rightwardly from the point (19') on the horizontal line passing through the point (18'), marking a point (23') 5.3 cm rightwardly from the point (21') along the cuff line emanating horizontally from the point (20'), drawing horizontal lines (27'), (28') and (29') at respective distances from the horizontal line passing through point (1') corresponding to the measures (2A), (3A) and (5A), respectively, connecting the points (5'), (19') and (21') by a curved line, the latter curved line defining intersection points (40') and (41') with lines (28') and (29'), respectively, the points (17'), (22') and (23') by a curved line, the latter curved line defining intersection points (37'), (38') and (39') with lines (27'), (28') and (29'), respectively, the points (26'), (15') and (13') by a curved line, the latter curved line defining intersection points (34'), (35') and (36') with lines (27'), (28') and (29'), respectively, conecting the points (25') and (12') by by another curved line, the latter curved line defining intersection points (31'), (32') and (33') with the lines (27'), (28') and (29'), respectively, and joining the points (21'), (20'), (26') and (25') substantially along a straight line, marking a point (24') midway between the points (21') and (23'), marking a point (25') 2.5 cm below the horizontal line emanating from the point (20'), and at a distance equal to [$\frac{1}{2}$ the measure (6)+7.5 cm]+0.3 cm, marking a point (26') at 0.6 cm leftwardly of the point (25'), defining a large arm width occurring at the measure (2A) as the distance between the points (2') and (31'), and defining a small arm width at the preceeding measure as the distance between the points (37') and (34'), and setting the large arm width plus the small armwidth at the aforesaid preceeding measure to be not less than measure (2)+4 cm, defining a lower large part arm width occurring at the measure (3A) as the distance between the points (40') and (32'), and defining a lower small part arm width at the preceeding measure as the distance between the points (38') and (35'), and setting the lower large part arm width plus the lower small part armwidth at the aforesaid preceeding measure to be not less than measure (3)+4 cm, defining a lower large elbow width occurring at the measure (5A) as the distance between the points (41') and (33'), and defining a lower small part elbow width at the preceeding measure as the distance between the points (39') and (36'), and setting the lower large part elbow width plus the lower small part elbow width at the aforesaid preceeding measure to be not less than measure (5)+4 cm, and marking a shrinkage curved line (30') within a substantially rectangular area defined by the points (35'), (32'), (33') and (36').

3. In a process of preparing a sketch to be used as a pattern for tailoring a garment as defined in claim 2, the method comprises steps which are mirror-symmetrical about an axis coinciding with a vertical bodice center line.

4. In a process of preparing a sketch to be used as a pattern for tailoring a garment, and in particular a sleeve made up of two pieces of cloth to fit the arm of a human figure of predetermined dimensions, wherein firstly the terminal ends of each shoulder are defined as shoulder points, secondly the circumference around each arm beneath each respective armpit is defined as measure (2), while the shortest distance from the shoulder point to the respective armpit is defined as measure (2A), thirdly the circumference around each arm 2.5 cm above a respective elbow is defined as measure (3), while the shortest distance from a shoulder point to the respective preceeding circumference is defined as measure (3A), fourthly the circumference around a largest part of each arm beneath a respective elbow is defined as measure (4), while the shortest distance from a shoulder point to the respective preceeding circumference is defined as measure (4A);

fifthly the circumference around another largest part of each arm beneath a respective elbow and below said measure (4A) is defined as measure (5), while the shortest distance from a shoulder point to the respective preceeding circumference is defined as means (5A), sixthly the circumference around each respective wrist is defined as measure (6), seventhly the distance from each shoulder point to a respective cuff of the garment is defined as measure (7), and eighthly the distance from each front armpit to each respective back armit is defined as measure (8), the steps comprising drawing a straight sleeve central line inclined at 15° from the horizontal from a point (1″) leftwardly through a point (2″) to a point (3″), and setting the spacing between the points (2″) and (3″) corresponding to the measure (7), while the spacing between the points (1″) and (2″) corresponds to about 1/5 the spacing between the points (2″) and (3″), marking points (4″) and (6″) on said sleeve central line, and setting the spacing between points (2″) and (4″), on one hand, and point (2″) and (6″), on the other hand, equal to the measures (3A) and (5A), respectively, drawing lines at right angles to said sleeve central line in a downward direction from points (4″), (6″) and (3″) to terminate at respective points (5″), (7″), and (8″), and up to respective lengths corresponding to the ½ measure (3), to the ½ measure (5), and to the ½ measure (6) respectively, the line (3″) to (8″) corresponding to a cuff line, drawing a line from the point (1″) leftwardly about ¼ of the distance separating points (2″) and (3″) for arriving at a point (9″A), and drawing from a leftmost terminal of the preceeding line a vertical downwardly at a spacing about ¾ of the distance separating points (2″) and (5″), connecting the points (8″), (9″), (7″), (5″) and (9″A) by smoothly curved line (9″), drawing a line rightwardly from the point (9″A) to a distance corresponding to about ½ the spacing between the points (2″) and (3″) resulting in a point (9″B), drawing a vertical line from the point (9″B) resulting in a point (9″C) at a spacing corresponding to about ¾ the distance between the points (2″) and (3″), and connecting the points (9″C) and (1″) by a slightly concave curve coresponding to a wearer's neckline, the conecting lines between the points (9″A), (9″B), (9″C), (1″) and (2″) defining the countour of a first half of a bodice, the line (9″B)–(9″C) defining a vertical body line.

5. In a process of preparing a sketch to be used as a pattern for tailoring a garment as defined in claim 4, the method comprises steps which are mirror-symmetrical about an axis coinciding with the with a vertical bodice center line.

6. In a process of preparing a sketch to be used as a pattern for tailoring a garment, and in particular a sleeve made up of two pieces of cloth to fit the arm of a human figure of predetermined dimensions, wherein firstly the terminal ends of each shoulder are defined as shoulder points, secondly the circumference around each arm beneath each respective armpit is defined as measure (2), while the shortest distance from the shoulder point to the respective armpit is defined as measure (2A), thirdly the circumference around each arm 2.5 cm above a respective elbow is defined as measure (3), while the shortest distance from a shoulder point to the respective preceeding circumference is defined as measure (3A), fourthly the circumference around a largest part of each arm beneath a respective elbow is defined as measure (4), while the shortest distance from a shoulder point to the respective preceeding circumference is defined as measure (4A);

fifthly the circumference around another largest part of each arm beneath a respective elbow and below said measure (4A) is defined as measure (5), while the shortest distance from a shoulder point to the respective preceeding circumference is defined as means (5A), sixthly the circumference around each respective wrist is defined as measure (6), seventhly the distance from each shoulder point to a respective cuff of the garment is defined as measure (7), and eightly the distance from each front armpit to each respective back armit is defined as measure (8), the steps comprising drawing a straight line inclined at 15° from the horizontal from a point (1″) leftwardly to a point (2″), drawing a sleeve central line from the point (2″) inclined at 35° with the horizontal leftwardly to a point (10″), setting the spacing between points (2″) and (10″) corresponding to the measure (2), while the spacing between the points (1″) and (2″) corresponds to about 1/5 the spacing between the points (2″) and (3″), marking points (15″) and (17″) on said sleeve central line, and setting the spacing between points (2″) and (15″), on one hand, and point (2″) and (17″), on the other hand, equal to the measures (3A) and (5A), respectively, marking points (11″), and (13″) on said sleeve central line, and setting the spacings between point (2″) on one hand, and points (11″), and (13″), on the other hand, to distances corresponding respectively to ¼ and measure 7 of the distance between the points (2″) and (15″), drawing lines at right angles to said sleeve central line in a downward direction from points (15″), (17″) and (10″) to terminate at respective points (16″), (18″), and (19″), and up to respective lengths corresponding to the ½ measure (3), to the ½ measure (5), and to the ½ measure (6) respectively, the line (10″) to (19″) corresponding to a cuff line, drawing lines at right angles to said sleeve central line in a downward direction from points (11″), and (13″) to terminate at respective points (12″), and (14″), and up to respective lengths corresponding to the ¼ measure (3A), and to the 4/5 measure (3A) respectively, for arriving at a point (9″A) draw a line from the point (1″) leftwardly about ¼ of the distance separating points (2″) and (10″), and from a leftmost terminal of the preceeding line draw a vertical downwardly at a spacing about ¾ of the distance separating points (2″) and (10″), connecting the points (19″), (18″), and (16″) by smoothly curved line (20″), a point (16″B) lying on a continuation of the line connecting the points (18″) and (16″) intersecting with the vertical emanating upwardly from the point (9A″), drawing a line rightwardly from the point (9″A) to a distance corresponding to about ½ the spacing between the points (2″) and (3″) resulting in a point (9″B), drawing vertical line from the point (9″B) resulting in a point (9″C) at a spacing corresponding to about ¾ the distance between the points (2″) and (3″), connecting the points (9″C) and (1″) by a slightly concave curve coresponding to a wearer's neck-line, the conecting lines between the points (9″A), (9″B), (9″C), (1″) and (2″) defining the countour of a first half of a bodice, drawing a line (21″) inclined at an angle of about 53° with the horizontal rightwardly from the point (16″B), drawing a horizontal line leftwardly from a point (9″D) situated vertically about ⅓ the distance between the points (2″) and (10″), and marking a point (12″A) at an intersection of the preceeding horizontal line with the line (21″), drawing a curved line (21″A) smoothly connecting the points (12″A), (12″) and (2″), and drawing a smoothly curved line (22″A) connecting points (12″A), (12″) and an approximate midway point of the line connecting the points (1″) and (9″), said line (22″A) defining a cutting line adapted for the insertion of a gore, the line (9″B), (9″D) and (9″C) defining a bodice center line.

* * * * *